US005520603A

United States Patent [19]

Bluthardt et al.

[11] Patent Number: 5,520,603

[45] Date of Patent: May 28, 1996

[54] BUCKLE CHUTE FOLDER WITH SINGLE SELECTOR KNOB FOR MULTIMODE FOLDING OPERATION

[76] Inventors: Edward A. Bluthardt; Robert A. Bluthardt, both of 6612 Lakepointe, Utica, Mich. 48089; Noel L. Noble, 23313 Melville, Hazel Park, Mich. 48030; Jeffrey L. Goins, 55605 Card Rd., New Haven, Mich. 48048

[21] Appl. No.: 185,538

[22] Filed: Jan. 24, 1994

[51] Int. Cl.[6] ..... B65H 3/06

[52] U.S. Cl. ..... 493/421; 493/420

[58] Field of Search ..... 493/419, 420, 493/421

[56] References Cited

U.S. PATENT DOCUMENTS

| | | | |
|---|---|---|---|
| 3,150,871 | 9/1964 | Boblit | 493/421 |
| 3,178,171 | 4/1965 | Springer | 493/421 |
| 3,805,857 | 9/1957 | Policansky | 271/312 |
| 3,975,009 | 8/1976 | Brown | 493/421 |
| 4,272,066 | 6/1981 | Bouda | 493/418 |
| 4,586,704 | 5/1986 | Lehmann | 493/421 |
| 4,842,574 | 6/1989 | Noble | 493/421 |
| 4,850,945 | 7/1989 | Whittenberger | 493/420 |
| 5,246,415 | 9/1993 | Fuss | 493/421 |
| 5,269,744 | 12/1993 | Moll | 493/420 |
| 5,284,467 | 2/1994 | Meschi | 493/412 |
| 5,322,498 | 6/1994 | Lehmann | 493/421 |

FOREIGN PATENT DOCUMENTS

| | | | |
|---|---|---|---|
| 349501 | 9/1931 | Germany | 493/420 |

*Primary Examiner*—Bruce M. Kisliuk
*Assistant Examiner*—Christopher W. Day
*Attorney, Agent, or Firm*—John R. Benefiel

[57] ABSTRACT

A buckle chute folding machine is described which has a single selector knob which selects a variety of fold patterns by simultaneous adjustment of the position of a stop blade in a buckle chute and a deflector bar positionable with respect to a nip roller set to either prevent or allow a second fold to be executed. An automatic paper feed system is provided to feed sheets from a holder tray, each sheet advanced incrementally into the machine to preclude double or overlapped feeding of the sheets through the nip roller sets.

11 Claims, 11 Drawing Sheets

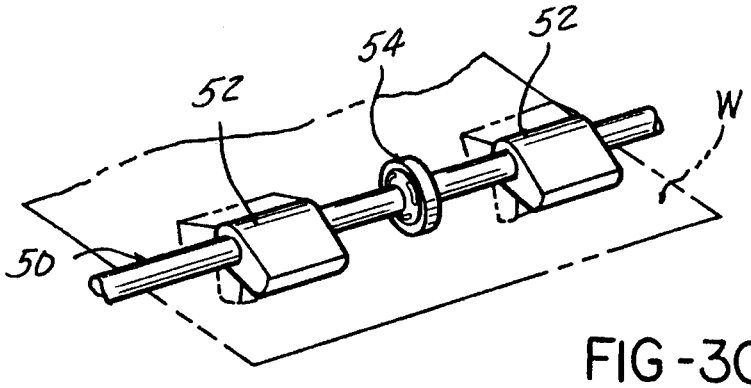
FIG-3C
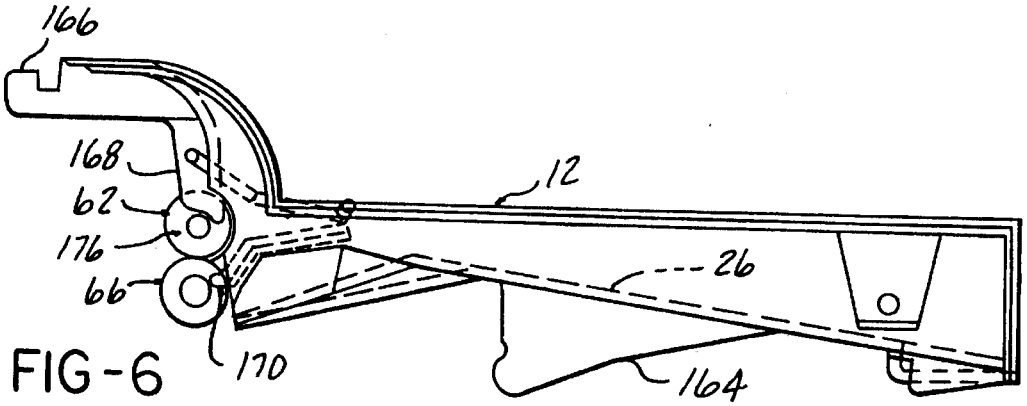
FIG-6
FIG-7
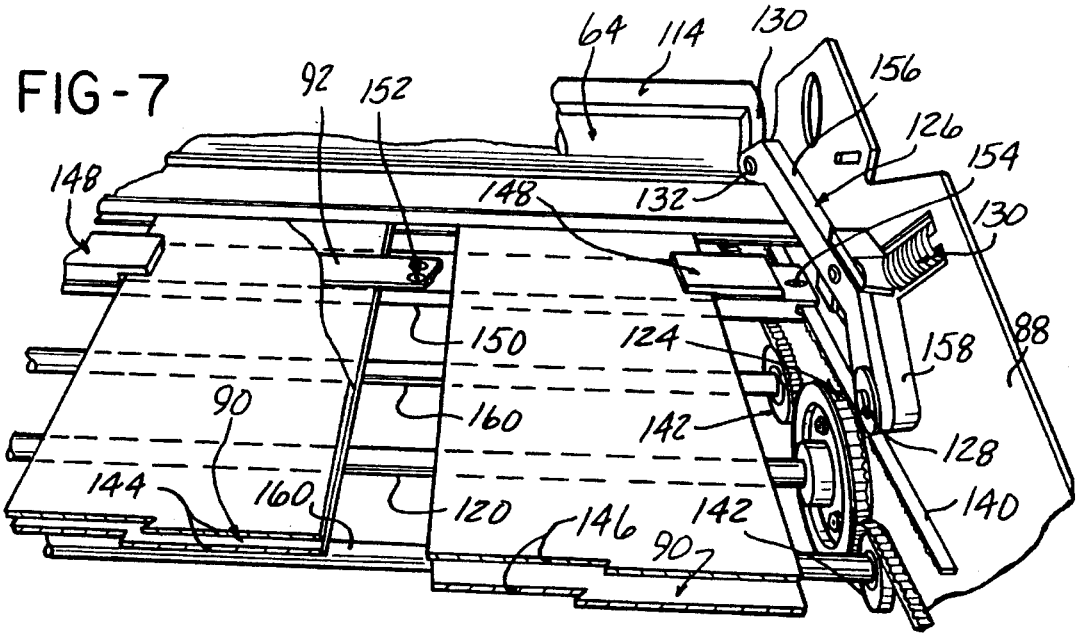

BUCKLE CHUTE FOLDER WITH SINGLE SELECTOR KNOB FOR MULTIMODE FOLDING OPERATION

BACKGROUND OF THE INVENTION

This invention concerns "buckle chute" sheet folders in which a sheet of paper is driven against a stop with continued driving causing buckling of the sheet, the buckled paper drawn between a pair of mating nip rollers to fold the sheet across the width of the nip rollers. Such buckle chute folding machines are very well known in the art.

Reference is made to the present inventors' prior U.S. Pat. No. 4,842,574 issued on Jun. 27, 1989, for a "Buckle Chute Folder Having A Sheet Squaring Feature". Such machines are often adapted to varying paper sizes and allow differing fold patterns by adjustment of various machine elements. Such adjustments include adjusting the location of a stop, so as to vary the location whereat the buckle and fold on the sheet occurs.

In some folding machines, more than one fold is formed on a single sheet of paper by means of a second stage of buckling and folding, in which, after an initial folding stage, the folded paper is driven against a fixed stop and drawn into a second pair of nip rollers to cause the sheet to undergo a second folding step. By means of a movable deflector the machine can be adapted to selectively control the operation of the machine to either cause the sheet to pass into the second stage folding or to bypass the same.

Such adjustable stop and deflector elements are shown in the forementioned U.S. Pat. No. 4,842,574. See also U.S. Pat. Nos. 4,585,219; 5,076,556; 3,150,871; and 3,178,171.

For light duty machines intended for office use, it is important that the adjustment procedures for adapting the machine to various fold patterns be simple. At the same time, proper functioning of these machines also requires accurate squareness, alignment and location of the various elements, particularly the stops.

In prior U.S. Pat. No. 4,842,574 there is described a sheet squaring feature in which there is a controlled release of the paper sheet from the drive rollers intermittently to enable squaring of the sheet against the folder such that the folding occurs squarely across the width of the sheet to be folded.

A difficulty in providing adjustability has been in achieving the necessary accuracy in alignment of these elements after adjustments are made without requiring undue effort and skill in carrying out the adjustments. Such adjustability in the past has been achieved by means of a number of separately set elements, complicating the adjustment process.

It would also be advantageous if such folding machines could be provided with automatic sheet feeders and adapted to utilize cassette paper holder trays as are commonly used with modern copy machines. Again, the adaption of such automatic feeders for low cost machines is difficult due to the need for achieving very reliable operation of the machine without the need for painstaking adjustment or maintenance by skilled operating personnel.

Such machines also must be relatively low in cost and yet provide the highly reliable operation with minimal attention necessary for such application.

Another problem associated with sheet folders is the need to avoid misfeeding, double feeding, or reentry of the folded sheets into the roller sets comprising the drive and nip rollers.

It is also important to provide reliable collection and stacking of the folded sheets, particularly for automatic feed operation.

Accordingly, an object of the present invention is to provide a buckle chute folder intended for office use which is relatively simple and reliable in operation without requiring delicate or fine adjustments to be made by the operating personnel.

It is another object of the present invention to provide such buckle chute folding machine in which a single knob controls both a stop location and a deflector position in order to provide a number of operating modes which may be selected with manipulation of the knob.

It is yet another object to provide such folding machine in which the alignment and location of the stop element is accurately and reliably set such as to provide accurate and reliable operation of the machine in each of a number of folding modes.

It is still another of the present invention to provide an cassette sheet holder tray and automatic sheet feed mechanism which operates in a highly reliable manner avoiding malfunctions, to provide the convenience of automatic operation without causing unreliable operation of the machine.

SUMMARY OF THE INVENTION

The present invention comprises a buckle chute folding machine having an array of drive and nip roller mating roller sets with a first adjustable stop chute aligned with the feed roller set, and a second fixed stop chute located opposite a second nip roller set.

A movable deflector bar can be swung between two positions, a first, extended position deflecting a folded sheet passing through the first nip roller set to cause it to exit directly out of the machine without further folding. In a second, retracted position of the deflector bar, the once folded sheet is allowed to pass into the fixed stop buckle chute, causing buckling and a successive folding of the already folded sheet in the second nip roller set prior to exiting out of the machine.

According to the invention, the adjustable position stop blade and deflector bar are both controlled by rotation of a single selector knob. The selector knob drives a cross shaft having toothed pulleys located on either side of the machine engaging a respective toothed drive belt affixed to either end of the adjustable stop blade.

The adjustable stop blade is sandwiched between two sets of confining chute walls which are located to receive a sheet of paper driven by the drive roller set at the entrance to the machine.

The use of the synchronized drive belts provides accurate location of each end of the stop blade in each adjusted position corresponding to a particular rotated knob position to insure proper squareness of the stop blade.

The knob is detented in preselected adjustment positions, by means of a cam disc having perimeter indentations engaged by a spring loaded pivoted shifter lever used to shift the deflector bar between extended and retracted positions. The shifter lever operates to shift the position of the deflector bar which is mounted on short arms, each revolvably mounted with respect to each end of a roller in the first nip roller set.

The cam disc includes several detent locations which are sufficiently deep to cause significant movement of the deflector bar shifter lever at locations whereat the deflector bar is to be shifted. Thus, at particular adjustment positions of the adjustment knob, the deflector bar is shifted to a retracted position, allowing the folded sheets to pass into the fixed stop chute and cause a second stage folding operation between a second nip roller set prior to exiting out of the machine.

The second nip roller set includes a roller having a longitudinal feature such as a lengthwise groove recessed in the surface thereof, or a lengthwise series of raised protrusions. The surface feature or features act as an ejection surface acting after each paper sheet is driven out through the second nip roller pair. The feature or features engage the trailing edge of the previously exited sheet, so that the roller rotation will eject the sheet clear of the second nip roller pair. This ensures that succeeding sheets are deposited below the prior exiting folded sheet.

A molded top cover piece defines a sheet entrance slot for manual feeding and a paper exit slot receiving both manually and automatically fed sheets to be folded.

The entrance slot has a stepped configuration to accommodate two different paper widths.

The automatic paper feed system includes a sheet holder cassette which is loaded into the folding machine beneath a pair of eccentric feed rollers on a support shaft driven by the folding machine drive motor.

The feed roller support shaft is mounted on a pair of support arms which are spring biased to an elevated position which allows the cassette sheet holder tray to be slid beneath the rollers without contact therewith. As the cassette holder tray is fully inserted, the support arms are hinged downwardly by contact of the cassette tray end face lowering the support shaft and feed rollers to an operative position whereat they can engage the top sheet in the sheet stack in the holder tray.

A central, freely revolvable flattening roller is mounted between the two feed rollers, serving to flatten the paper stack compressed within the cassette tray ensuring proper contact of the feed rollers.

The cover piece is also provided with a ramp feature ensuring flattening of the paper stack such as to ensure that the paper stack does not engage the feed rollers when the cassette tray is in the process of being installed.

The cassette sheet holder tray is located by means of locating fingers at the forward end thereof mating with openings in the folding machine housing and has bottom features engaging locator stops upon urging back of the tray after insertion thereof under the action of the support arm springs.

The feed rollers are eccentrically configured such as to only intermittently engage the top most sheet of paper in the cassette tray ensuring the prior delivered sheet to be advanced through the various rollers sets prior to introduction of the next sheet of paper from the stack in the cassette holder tray.

BRIEF DESCRIPTION OF THE DRAWINGS

FIG. 3C is a perspective view of the feed and flattening rollers and support shaft included in the feed mechanism of the folding machine shown in FIG. 1, depicting in phantom a sheet of paper and rotated position of the feed rollers.

FIG. 6 is a side elevational view of the cover piece included in the folding machine shown in FIG. 1.

FIG. 7 is an enlarged fragmentary perspective view with portions broken away of the folding machine shown in FIG. 1 showing components of the adjustable stop and deflector gate bar included in the folding machine according to the present invention.

DETAILED DESCRIPTION

In the following detailed description certain specific terminology will be employed for the sake of clarity and a particular embodiment described in accordance with the requirement of 35 USC 112 but it is to be understood that the same is not intended to be limiting and indeed should not be so construed inasmuch as the invention is capable of taking many forms and variations within the scope of the appended claims.

Figure 1:
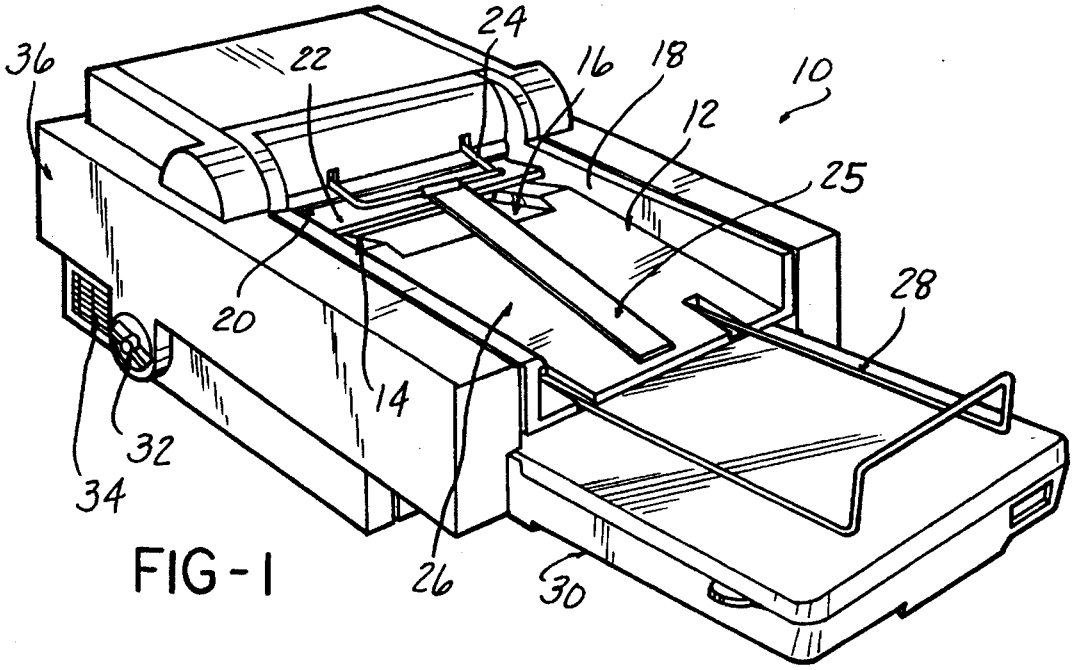
FIG. 1 is a perspective view of the folding machine according to the present invention.

Referring to the drawings, and particularly FIG. 1, the folding machine 10 according to the present invention includes a top cover piece 12 of molded plastic which defines an entrance slot 14 into which sheets of paper to be folded may be manually introduced.

The slot 14 includes an auxiliary narrower width portion 16 to guide narrow width paper i.e., wider sheets (standard sheets) such as 8½ inches wide occupy the total distance between side walls 18. Narrower width sheets such as 5½ inch width sheets can be guided in the narrower width portion 16.

Folded sheets exit through slot 20 defined above a horizontal partition piece 22 separating the entrance slot 14 and exit slot 20.

A movable bail 24 extends above the exit slot 20 with a strap 25 connected to central portion thereof extending over a sloping ramp surface 26 receiving a succession of folded sheets exiting from the exit slot 20 and advanced down the surface 26 as successive sheets are driven out through the exit slot 20 and onto a collection rack 28 mounted in the end of the top cover piece 12.

A cassette sheet holder tray 30 which provides for optional automatic sheet feed is inserted beneath the cover piece 12, projecting beyond the end of the main portion of the folding machine 10 and beneath the collection rack 28.

The details of the cassette sheet holder tray 30 will be described hereinafter.

Figure 1A:
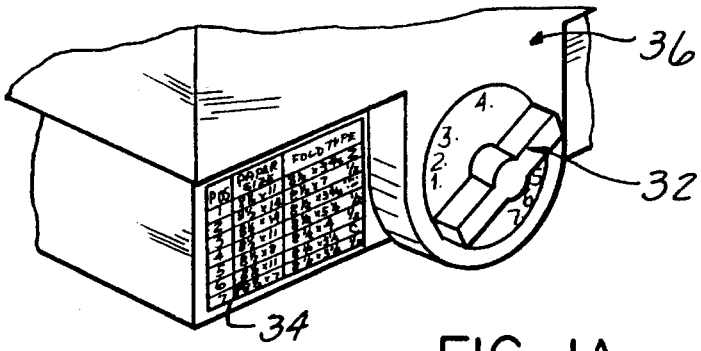
FIG. 1A is an enlarged fragmentary perspective view of the adjustment knob and chart incorporated in the folding machine of FIG. 1.

The folding machine 10 has a capacity for adjustability to accommodate varying paper sizes and execute varying folding patterns by rotation of a single control knob 32 as seen more clearly in FIG. 1A with a reference chart 34 affixed to a side cover 36 of the machine 10. This chart lists the seven adjusted conditions of the folding machine 10 as follows:

| Pos. | Paper Size | Fold Type | |
|---|---|---|---|
| 1. | 8½ × 11 | 8½ × 3¾ | Z |
| 2. | 8½ × 14 | 8½ × 7 | ½ |
| 3. | 8½ × 14 | 8½ × 3¾ | Legal Double Parallel |
| 4. | 8½ × 11 | 8½ × 5½ | ½ |
| 5. | 5½ × 8 | 5½ × 4 | ½ |
| 6. | 8½ × 11 | 8½ × 3¾ | C |
| 7. | 8½ × 7 | 8½ × 3½ | ½ |

Figure 2:
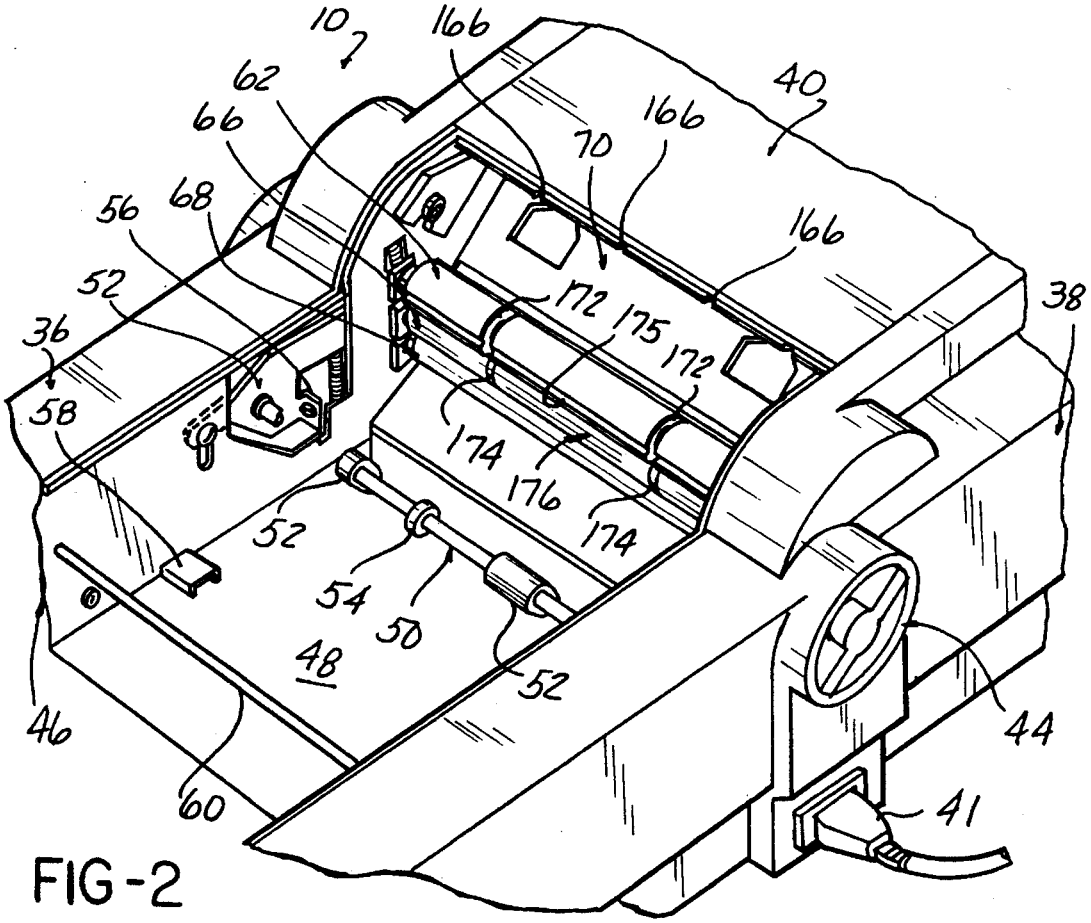
FIG. 2 is an enlarged fragmentary perspective view of the machine shown in FIG. 1 with the upper cover piece and cassette tray removed.

FIG. 2 illustrates the machine with both the cover piece 12 and the cassette sheet holder tray 30 removed.

The folding machine 10 includes side covers 36 and 38 as well as a rear top cover 40 which are secured by means of suitable fasteners.

A power supply plug 41 is inserted in a suitable receptacle open on the cover 38 opposite the cover 36, the selector knob 32 also installed on the same side.

A manual rotation knob 44 allows manual rotation of the feed and nip roller sets some of which can be seen in FIG. 2.

The side covers 36 and 38 and the top cover 40 may be constructed of suitable molded plastic and are attached to a formed sheet metal support housing 46 providing a structural support for the various functional components of the folding machine 10.

The cassette sheet holder tray 30 fits into the lower section of a generally rectangular trough area 48 defined within the housing 46 sliding beneath an automatic feed roller shaft 50 extending transversely across the rectangular space 48.

Either end of the support shaft 50 is mounted on a respective one of a pair of feed shaft support arms 51. A pair of paper drive rollers 52 are mounted at spaced locations on the shaft 50 with a flattening roller 54 rotatably mounted thereon at a central location therebetween.

The cassette sheet holder tray 30 is adapted to be slid into the rectangular lower space 48 passing beneath the roller shaft 50 and the drive rollers 52, with the leading end coming to abut against inwardly turned tabs 56 formed on each of the support arms 52. Further advance causes the support arms 51 to be pivoted downwardly to lower the feed rollers 52 into engagement with the top sheet of a stack disposed within the cassette sheet holder tray 30, as will be described hereinafter in further detail.

The cassette sheet holder tray 30 when released will move out slightly to engage locator stops 58 on the bottom of the space 48.

A stiffener rod 60 also extends across the space 48 and stabilizes the side walls of the metal housing 46.

As noted, three of the drive and nip rollers 62, 64, 66 are visible in FIG. 2 shown extending across the space 48 at the inmost side thereof.

Also visible in FIG. 2 is a fixed stop chute 70 which shall be described in further detail hereinafter.

Figure 3:
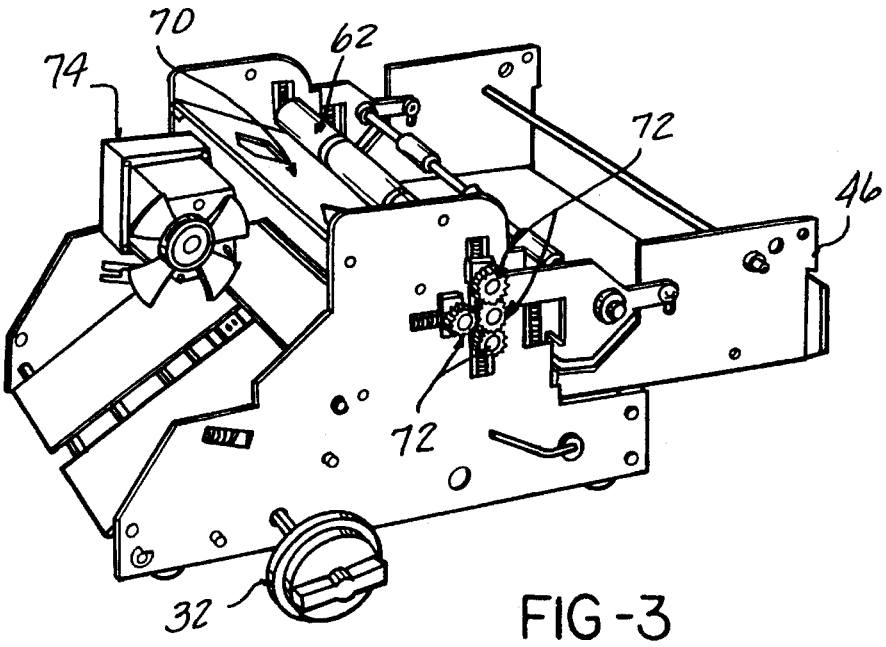
FIG. 3 is a perspective view of the machine shown in FIG. 1 with the external covers and cassette tray removed.
Figure 3A:
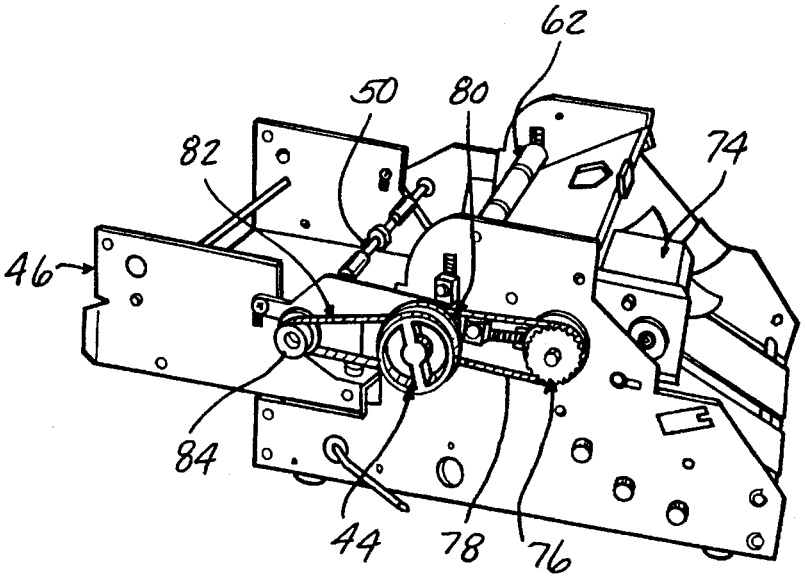
FIG. 3A is a perspective view of the folding machine shown in FIG. 1 with the cover and cassette tray removed viewed from the opposite side as FIG. 3.
Figure 3B:
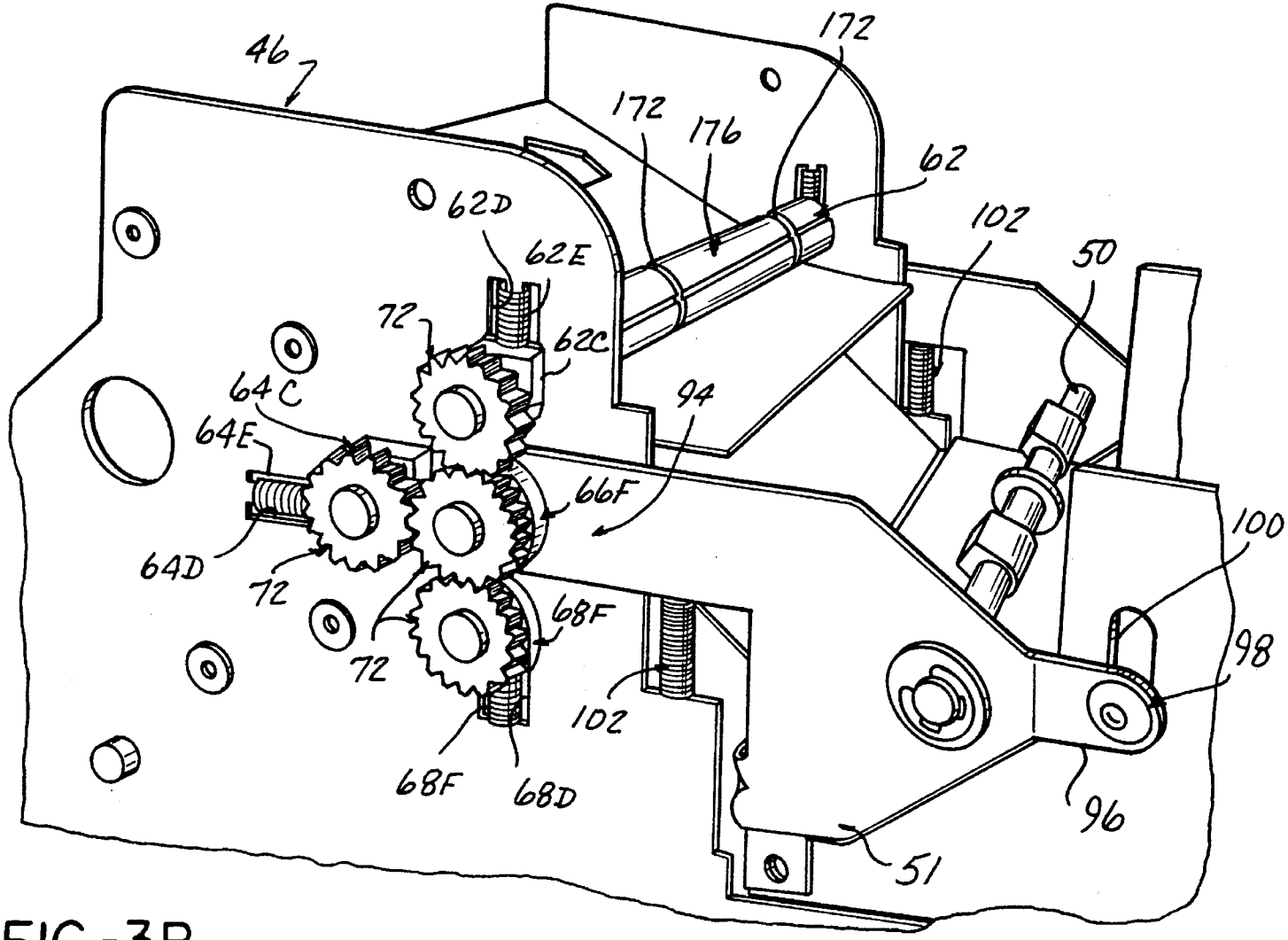
FIG. 3B is a fragmentary enlarged perspective view of the machine portions shown in FIG. 3.

As seen in FIG. 3B, the rollers 62, 66, 68 as well as an roller 64 (FIGS. 4, 4A) are all geared together by means of pinion gears 72, each affixed to one end of each of the rollers which are in mesh with each other such that synchronized rotation of each of the rollers feed and nip rollers is ensured. Rollers 62, 64, 66 and 68 may be constructed of a steel rod having rubber (65 Durometer) cylinders fixed thereto.

All of the rollers are driven by rotation of the center or drive roller 66 by an electric drive motor 74, which rotates a pulley 76 which in turn driving a toothed drive belt 78 rotating a pulley wheel 80 affixed to the opposite end of the center roller 66 such as to cause rotation of the center roller 66 and thus the upper and lower rollers 62, 68 (FIGS. 3).

The feed roller support shaft 50 is also rotated by the drive motor 74 by means of an additional toothed belt 82 driven by the pulley 80, which engages another smaller diameter pulley wheel 84 affixed to one end of the feed roller shaft 50. Thus, energization of the electric motor 74 causes all of the rollers and the shaft 50 to be continuously rotated in synchronism with each other.

Figures 4, 4B:
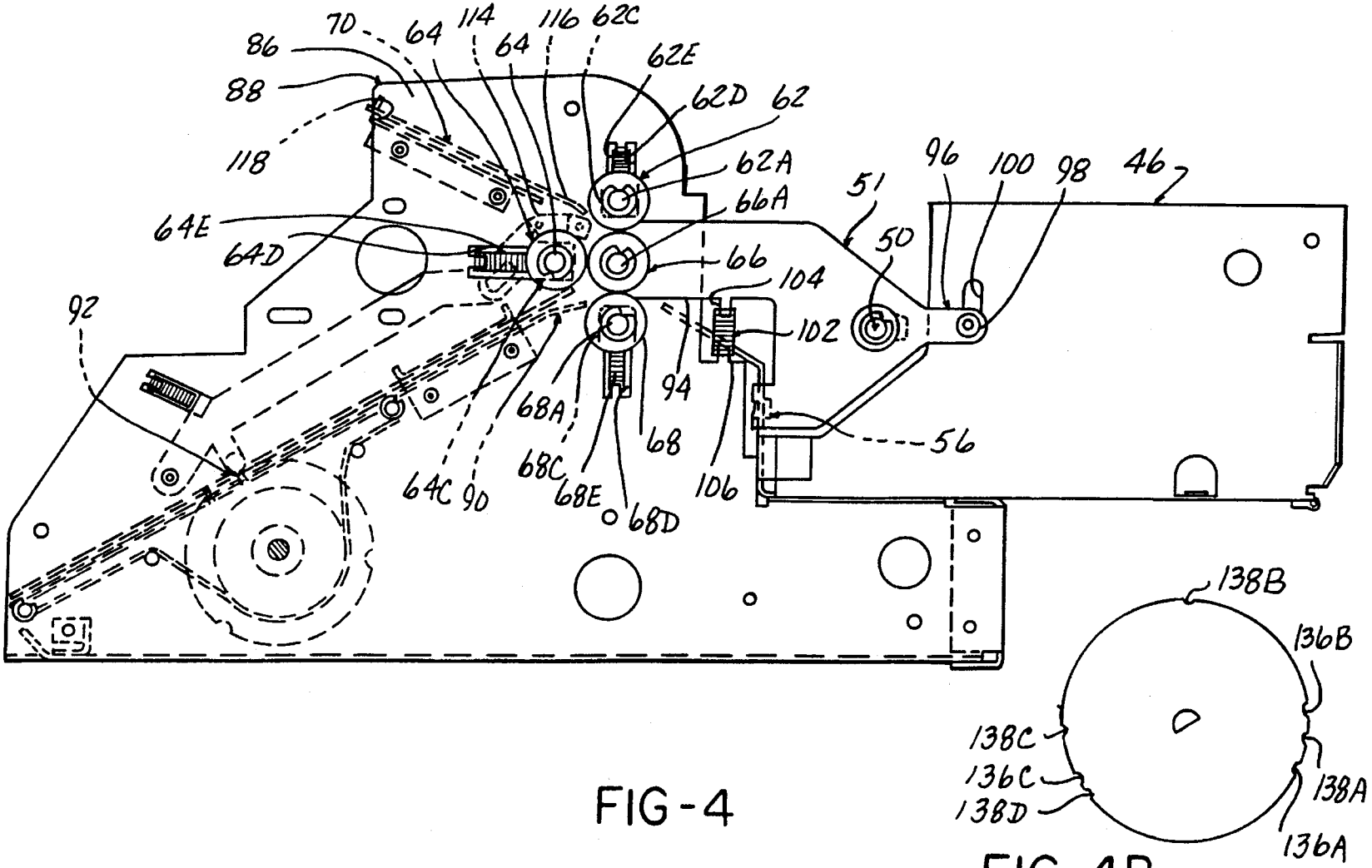
FIG. 4 is a side elevational view of the machine shown in FIG. 1 with the covers removed.
FIG. 4B is a plan view of the cam disc shown in FIG. 4A.

The upper roller 62, lower roller 68, and inner roller 64 are each spring biased to be frictionally engaged with the perimeter of the main drive roller 66, as best seen in FIG. 4. Each of the ends of the peripheral rollers 62, 64, 68 are floatingly mounted in the side walls 86 of the main housing 88 by means of slider elements 62C, 68C, 64C fit into respective slots 62D, 68D, 64D so as to be movable radially away from the main drive roller 66 against the bias of respective spring elements 62E, 68E, 64E received over tabs defined within the respective slots 62D, 68D, 64D. The slider elements may be constructed of molded plastic, such as Nylon, Delrin, or Teflon. This allows the sheets to be driven between the contacting surfaces of the rollers in the manner well known in the art.

The main drive roller 66 cooperates with the lower roller 68 to form a drive roller set which receives sheets of paper either from the manual feed or from an automatic feed from the cassette sheet holder tray 30, advances the sheet into an adjustable stop chute 90, advancing the same down the chute 90, and into engagement with an adjustable stop blade 92 in order to induce buckling.

In order to ensure proper squaring of the sheet against the stop blade 92, a camming arrangement is provided operated so as to cause intermittent separation of the main drive roller 66 and the lower drive roller 68 by means of a camming action created by cams 66F and 68F at each end of these rollers (FIG. 3B). This is described in detail in the aforementioned U.S. Pat. No. 4,842,574 and hence further details are not provided herein.

Suffice it to say, that as each sheet is advanced against the adjustable stop blade 92, the roller engagement of the sheet by the drive roller pair 66, 68 is interrupted momentarily so that the sheet can be shifted as necessary as it is driven by the feed system (or manually advanced) to be aligned against the adjustable stop blade 92 to ensure perfect squareness prior to further feeding and folding of the sheet.

Further details can be seen of the support arm mounting arrangement for the support arm 51 mounting the paper feed shaft 50. The support arm 51 includes a forward portion 94 which is rotatably received over the end 66A of the roller support shaft either in of the roller support shaft 66A.

A protruding tab 96 has a pin 98 received in a slot 100 formed in a side wall of the auxiliary housing 46, (FIG. 3B) thus, allowing limited swinging movement of the support arm 51 downwardly when the cassette tray 30 is inserted. A bias spring element 102 is received on each opposing tabs 104 and 106 (FIG. 4) shaped in the inside of the support arm 51 and a shoulder contour on the side wall 86.

The bias spring elements 102 each urge a respective support arm 51 to the upward position. When the cassette sheet holder tray 30 is inserted, the buttons 56 are contacted which forces both support arms 51 downwardly as the cassette sheet holder tray 30 is forced inwardly to the left as seen in FIG. 4, causing the support arms 51 to swing downwardly to the position shown in FIG. 4 which swings the feed roller support shaft 50 downwardly and brings the feed rollers 52 into a position to engage the uppermost sheet of the paper stack contained in the cassette sheet holder tray 30.

When the inserting pressure exerted on the cassette sheet holder tray 30 is released, the cassette sheet holder tray 30 will eject slightly, bringing stop features 108 formed on the bottom of the cassette tray 30 into engagement with locating stops 56 affixed to the bottom of the space 48.

Figure 5:
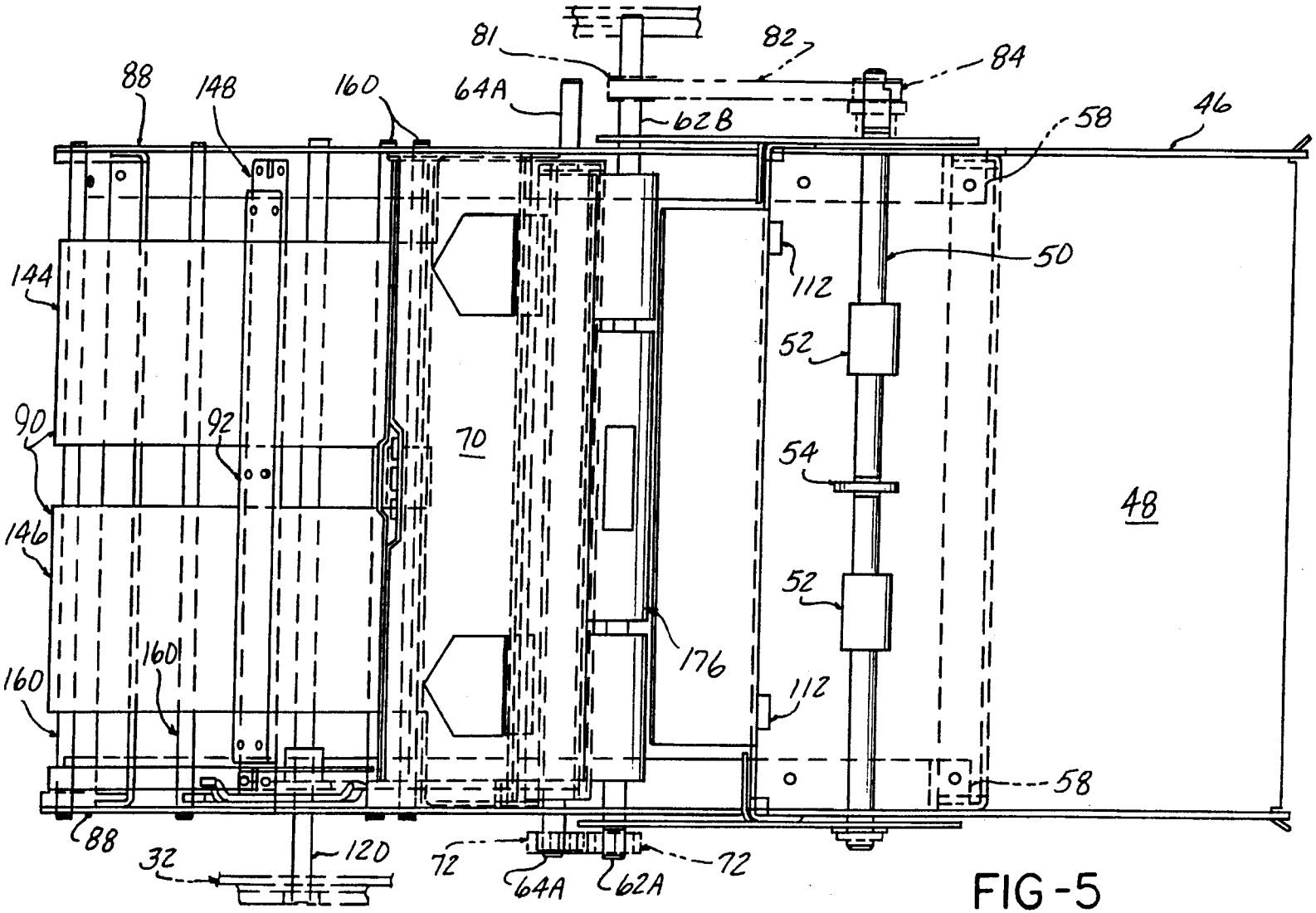
FIG. 5 is a plan view of the folding machine shown in FIG. 1 depicted with the covers and cassette holder tray removed showing certain of the drive components in phantom.
Figure 9:
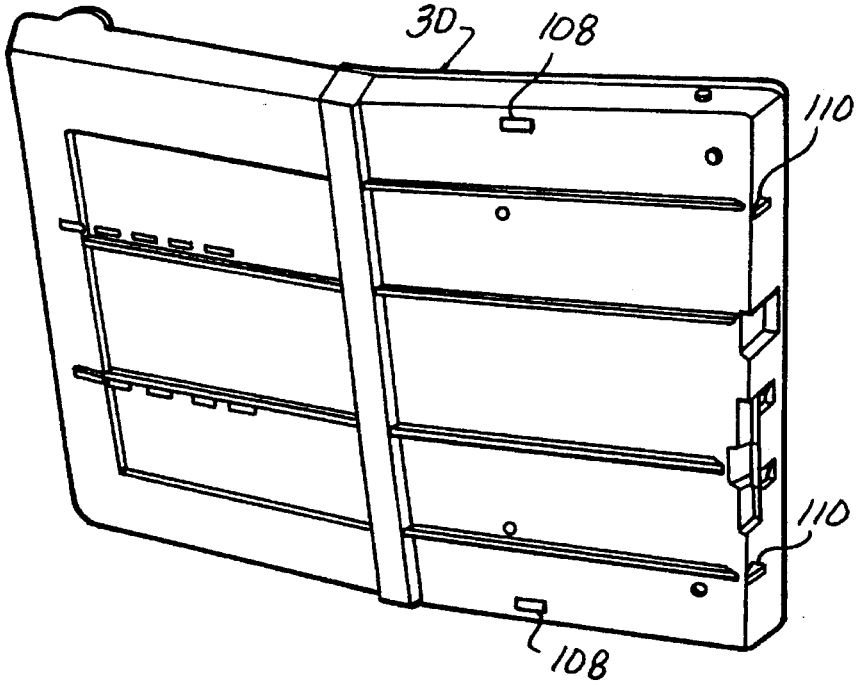
FIG. 9 is a bottom perspective view of the cassette sheet holder tray shown in FIG. 8.

The side-to-side alignment of the cassette sheet holder tray 30 is provided by forward fingers 110 (See FIG. 9) which are received in openings 112 formed in the forward partition wall of the auxiliary housing structure 46 (See FIG. 9 and FIG. 5).

The main drive roller 66 and the inside roller 64 together create a first nipping roller set which captures a buckling sheet of paper driven into the adjustable stop chute 90. The buckled sheet is then drawn and driven between the nip roller set comprised of first roller set 64 and 66 and then advanced upwardly into the space intermediate the three upper rollers, the main drive roller 66, the upper roller 62 and the inner roller 64.

Figure 4A:
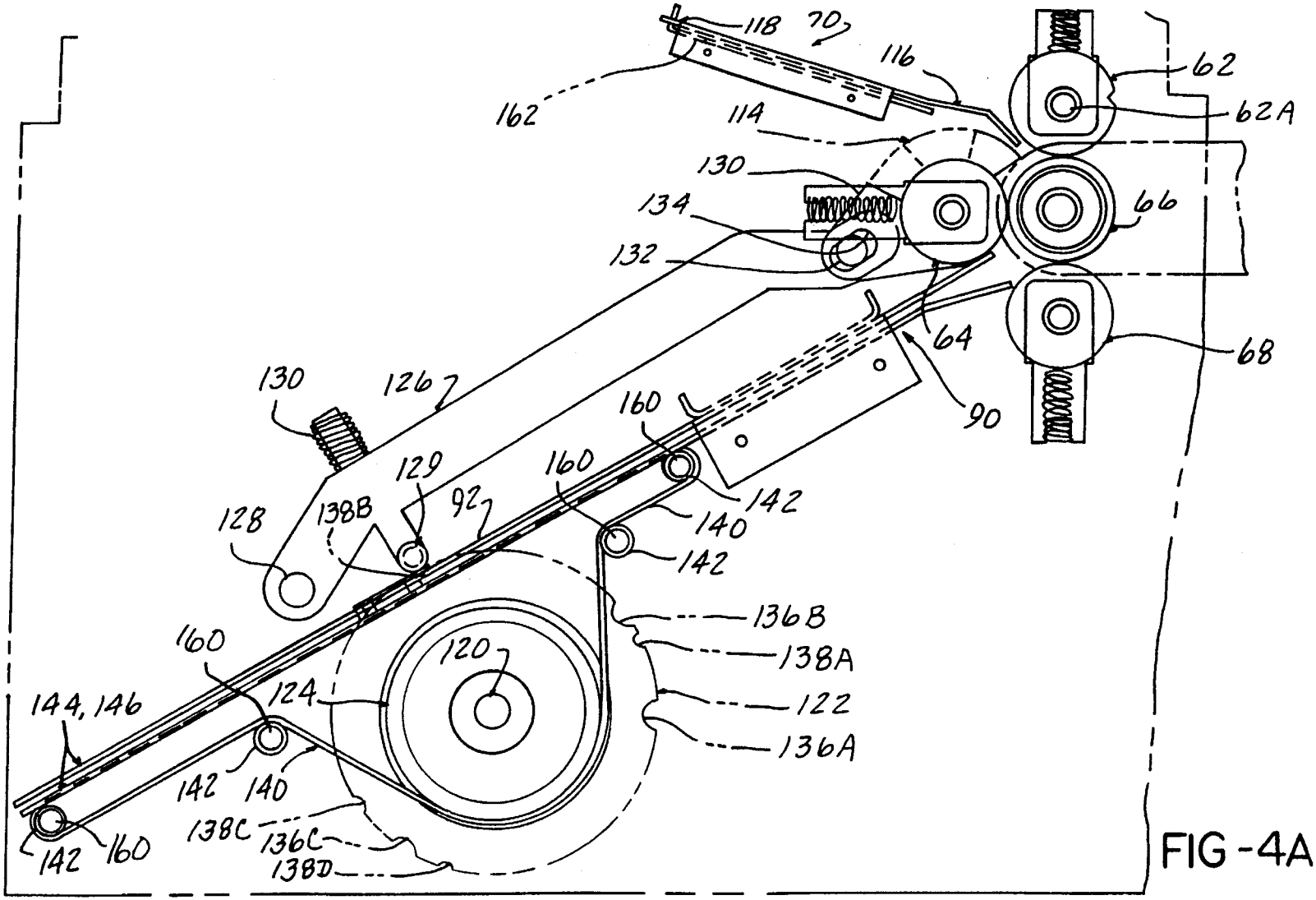
FIG. 4A is enlarged side elevational view of portions of the folding machine as shown in FIG. 4.

As best seen FIGS. 4A, the routing of the once folded sheet then depends on the position of a blocking deflector bar 114 which is movable in an arc about the axis of the inside roller 64 from a blocking position adjacent the main drive roller 66 to a retracted position withdrawn so as to allow the once folded paper to be driven upwardly and engage the forward lip 116 of the fixed stop chute 70. As the sheet is driven therein by the rotation of the main drive roller 66 against a fixed stop 118, it will again be buckled into the adjacent space, such that a second nip roller set comprised of the upper roller 62 and the main drive roller 66 will capture the buckle and execute a second folding step on the once folded sheet, passing the same out into the exit slot 20 of the housing.

According to the concept of the present invention, the shifted position of the deflector bar 114 and the adjusted position of the adjustable stop blade 92 are both simultaneously controlled by rotation of the selector knob 32. Selector knob 32 is affixed to a cross shaft 120 which is in turn fixed to a cam disc 122 and a pair of toothed pulleys 124 located on either side of the machine.

The cam disc 122 provides a detent at the various adjusted positions and also shifting of the deflector bar 114. This is accomplished by means of a shifter lever 126 pivoted at one end 128. The shifter lever 126 mounts a cam follower 128 and is urged counter clockwise with a spring 130 such as to urge the cam follower 128 into engagement with the perimeter of the cam disc 122.

The shifter lever 126 extends upwardly to a point adjacent the inside roller 64 and is pinned to an extension arm 130 integral with the deflector bar 114. Each end of the deflector bar 114 is supported for pivoting about the axis of the roller 64 by means of end pieces rotatably received in the side wall 86 of the main housing 88.

A pin 132 is carried by the free end of the shifter lever 126 received in an elongated slot 134 of the deflector bar extension arm 130 with the shifter lever 126 in its raised position, as illustrated in FIG. 4A, the deflector bar 114 is shown in its advanced position. However, when the cam disc 122 rotates to bring one of the three different, relatively deep depressions 136A, 136B, 136C into alignment with cam roller 128, the shifter lever 126 will rotate clockwise slightly, lowering the end thereof and causing pivoting counterclockwise of the extension arm 130 moving the deflector bar 114 to the retracted position.

The cam disc 122 is provided with four additional depressions 138A, 138B, 138C, 138D which provide additional detents to the rotated position of the cam disc 122 in addition to the detents provided by the three relatively deep depressions 136A, 136B, 136C (FIG. 4B). These detents each correspond to an adjusted position of the adjustable stop blade 92.

The shaft 120 when rotated causes simultaneous synchronous rotation of each of a pair of toothed belt pulleys 124 driving respective toothed drive belts 140. These belts 140 are attached to respective ends of the stop blade 92 causing the stop blade 92 to be moved within the adjustable stop chute 90 to positions corresponding to each of the detents 138A, 138B, 138C, 138D and 136A, 136B, 136C.

Each of the toothed drive belts 140 is guided by means of idler pulleys 142 such as to pass around the respective tooth pulley 124 thence extending lengthwise along the adjustable stop chute 90.

The constructional details of the chute 90 and mounting of the stop blade 92 can be understood by reference to FIG. 5 and 7.

The adjustable stop chute 90 consists of sets of closely spaced sections of sheet metal 144 and 146 which sandwich the stop blade 92 such that a sheet between sections 144, 146 will contact the stop blade 92.

The stop blade 92 is mounted at either end with end pieces 148 connected by a support bar 150 extending beneath the stop chute 90 riveted at 152 at the gap between the sheet metal piece sets 144 and 146. Each of the ends of the stop blade 92 is sandwiched between sections of the end pieces 148. End pieces 148 in turn are riveted at 154 to a respective toothed drive belt 140.

As can be seen in FIG. 7, the shifter lever 126 may be of two piece construction consisting of a metal arm 156 and a plastic piece 158 receiving a spring and carrying the cam follower (not shown in FIG. 7). This arrangement utilizes a single shaft 120 connecting the tooth pulley wheels 124 at either end and using toothed drive belts 140 and ensures precisely equalized movement of either end of the stop blade 126 along the adjustable stop chute 90 such as to ensure squareness in each adjusted position.

The sandwiched mounting of the stop blade 92 within the sheet metal sets 144 ensures that a sheet will be driven squarely against the stop blade 92. The idler pulleys 142 are interconnected by means of cross shafts 160 so as to provide further assurance of synchronized movement of the stop blade 92.

The fixed stop chute 70 locates the stop 118 at a fixed distance and cooperates with the adjustable stop chute 90 to provide a two fold mode of operation, as will be described hereinafter.

The fixed stop chute 70 also includes the upper sheet metal piece 116 previously mentioned and a lower sheet metal piece 162 spaced apart to receive the paper sheets without buckling therein.

As shown in FIG. 3C, rotation of the feed roller support shaft 50 causes rotation of the eccentric feed rollers 52 such as to cause intermittent advancement of a paper sheet (labelled W in FIG. 3C) from the cassette sheet holder tray 30.

Positioned below the cross shaft 50 is a stack flattening roller 54 which prevents improper contact with the eccentric rollers 52 which could be caused by bowing of the stack under the compression of being loaded into the cassette sheet holder tray 30.

In addition, the top cover piece 12, as seen in FIG. 6, is provided with a central fin 164 which also tends to flatten the sheet stack as the cassette sheet holder tray 30 is slid beneath the same.

The top cover piece 12 is held in position by means of a series of projecting ribs 166 which are received under the rear cover 40 which is notched (See FIG. 2) at 166 to receive the ribs 166. There are also a pair of downwardly projecting fingers 168 and rearwardly projecting fingers 170 molded into the top tray 12 which, with the top cover piece 12 assembled in position, and received in corresponding peripheral slots 172 formed in the upper roller 62 and slots 174 formed in the main drive roller 176.

The projecting fingers 168 and 170 ensure that the sheets are not reintroduced into the machine by adhering to the surface of the rollers 62 or 66 as the folded sheet is driven to exit the machine.

As can be seen in FIG. 2 and 3B the top roller 62 is formed with a longitudinal slot 175 which acts on the exiting sheet to provide an ejection action to ensure that the sheet is projected completely clear of the roller 62 when the next succeeding sheet is driven through the exit path.

Figure 11:
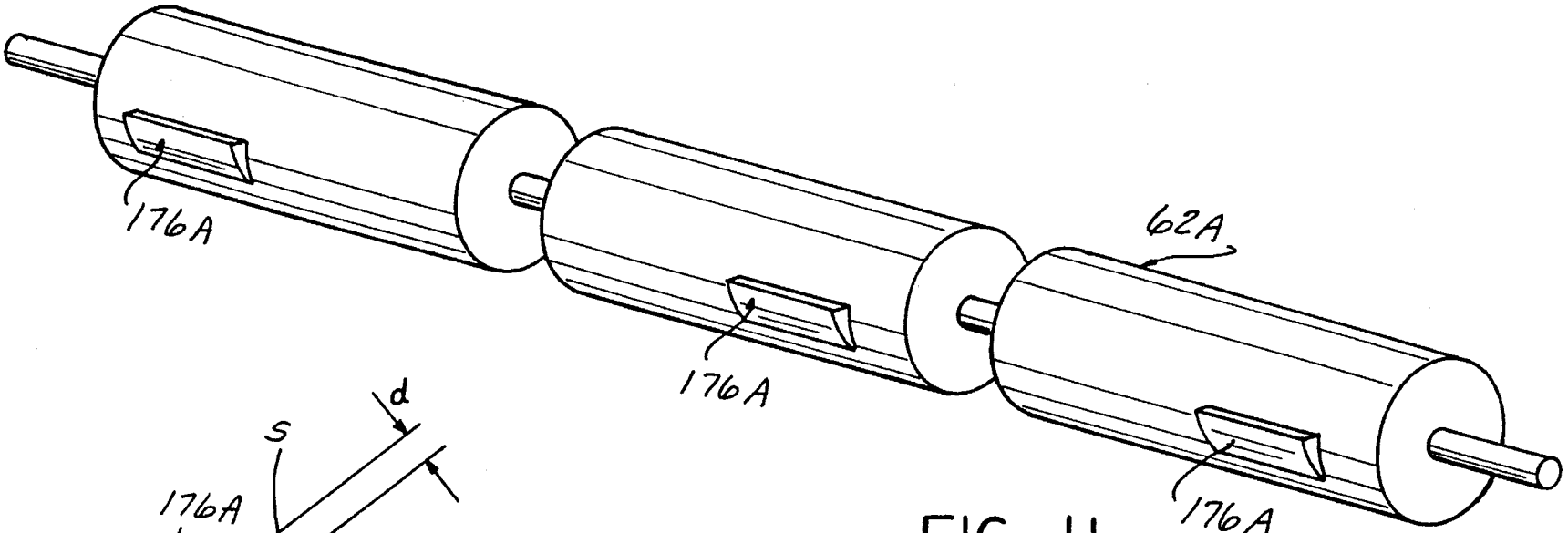
FIG. 11 is a perspective view of the upper roller illustrating the preferred form of the ejection feature.
Figure 11A:
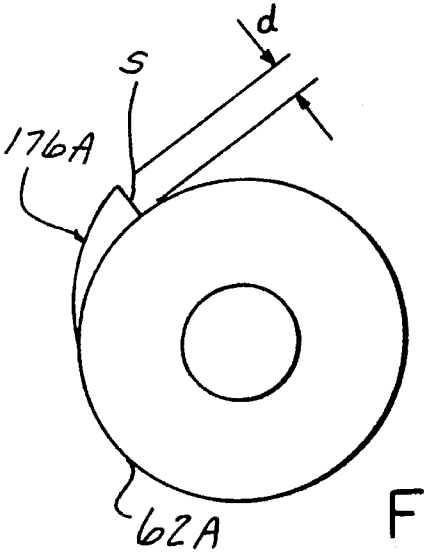
FIG. 11A is an endwise view of the upper roller shown in FIG. 11.

As seen in FIGS. 11, 11A three aligned lengthwise extending raised ridges 176A may be substituted for the longitudinal groove 176. This creates ejection features by the raised surfaces, elevated a slight distance (0.040") above the surface of upper roller 62A. This form is preferred where glossy paper sheets are to be folded.

It has been found that folded sheets 10 tend to rest against the perimeter of the upper roller 62 after exiting between the rollers 62 and 66. As the longitudinal slot 176 (or ridges 176A) again rotates around, the sheet is again engaged briefly and the continued rotation of the roller 62 (or 62A) ejects the same such as to make sure that each sheet after exiting beneath the stack of previously folded sheets. This ensures that upon exiting of the next successive folded sheet, that next successive sheet will underlie all of the sheets in the stack of previously folded sheets and ensure an orderly movement of the folded sheets down along the ramp surface 26 and onto the rack 28.

Without such means to project the sheet clear of the second nip roller set 62, 66, there is a possibility that a successive sheet could pass beneath the prior sheet and create disarray in the stack of folded sheets.

The intermittent drive produced by the eccentric rollers 52 which also may be of rubber (35 Durometer) is important to ensure adequate spacing of the folded sheets and to prevent successive sheets from passing through the various folding operations in an overlap condition.

In addition, the intermittent advance of the sheets W allows the squaring function to be accomplished when the rollers 66 and 68 momentarily separate with each revolution of a main drive roller 62.

Figure 8:
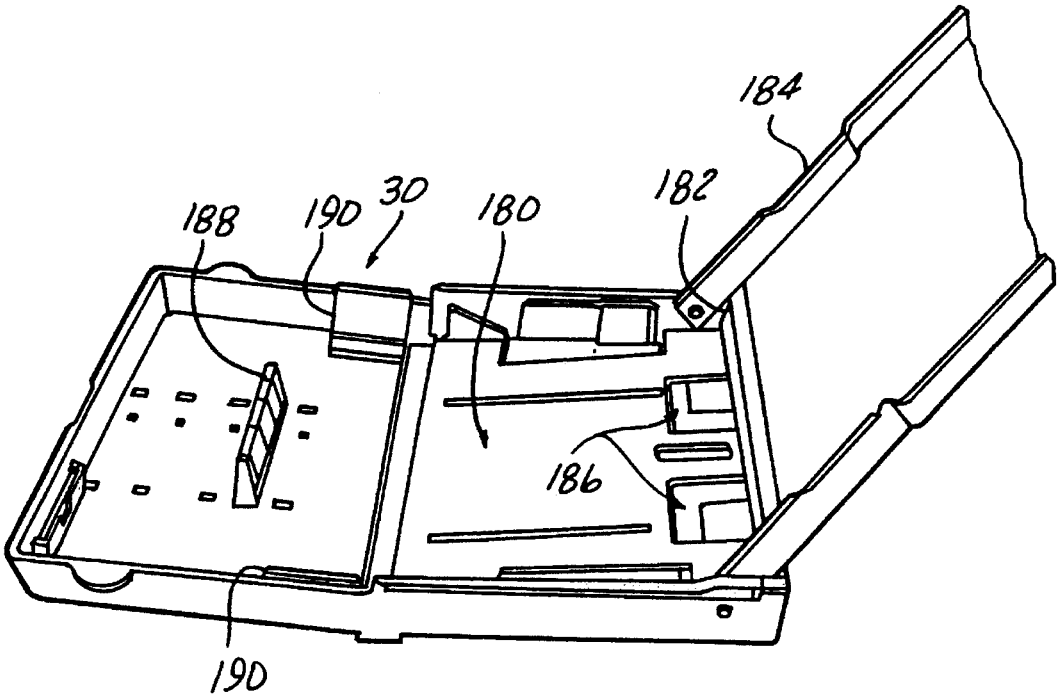
FIG. 8 is a fragmentary view of the cassette sheet holder tray included in the folding machine according to the present invention.

Additional details of the cassette sheet holder tray 30 can be seen in FIGS. 8 and 9. A spring loaded platform 180 which may be of substantially conventional design, urges a stack of sheets upwardly at the right end thereof as viewed in FIG. 8, allowing the eccentric feed rollers 52 to engage the right hand end of the topmost sheet through a opening 182 in the cover 184.

A pair of cork surfaces 186 has been utilized and found to create a frictional drag on the bottom most sheet to prevent double feeding of that sheet as the rollers encounter the last few sheets in the stack loaded within the cassette sheet holder tray 30.

An adjustable end piece 188 may be utilized to be used with various sheet lengths to be accommodated by the machine according to the present invention.

Side pieces 190 guide the side edges of the paper sheets in the stack so as to ensure a square positioning within the interior of the cassette sheet holder tray 30.

FIGS. 10A through 10G depict diagrammatically the functional relationship of the components and the paper folding pattern produced for each adjusted position 1 through 7 of the selector knob 32.

Figure 10A:
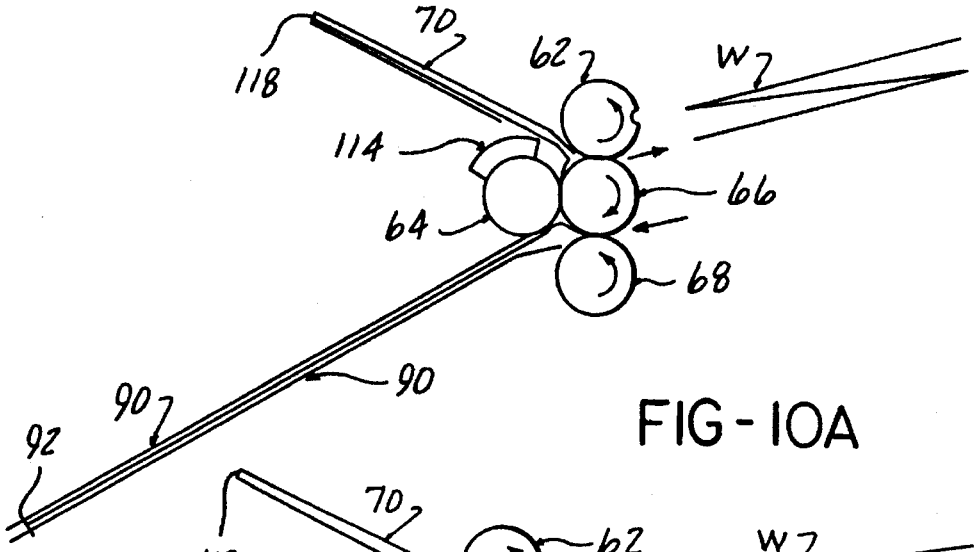
FIGS. 10A–10G are diagrammatic representations of the feed and nip rollers and adjustable and fixed stops, diagramming the folding action occurring in the various respective adjusted modes of the folding machine according to the present invention.

The following is a tabulation of the various modes available corresponding to each position 1 through 7:

Position 1 is shown in FIG. 10A. The blade stop 92 is in its adjusted position furthest away from the rollers, and the deflector bar 114 is in its retracted position. Accordingly, as a sheet of paper is fed in between the main drive rollers 66 and the lower roller 68, it passes down the full length of the adjustable stop chute 90 and is then buckled causing the first set of nip rollers comprised of the rollers 66, 64 to capture the buckled portion and drive the sheet therebetween to form a first fold.

Since the deflector 114 is in the retracted position, the folded end of the sheet moves into the fixed stop chute 70 driven by rotation of the drive rollers 66 to the end and into engagement with the fixed stop 118, causing a second buckling of the once folded sheet which is captured by the second set of nip rollers comprised of the main drive roller 66 and the upper drive roller 62 causing a second fold to be formed on the sheet W. Thus, the state of the machine elements in position 1 produces a Z fold as indicated in FIG. 10A.

Figure 10B:
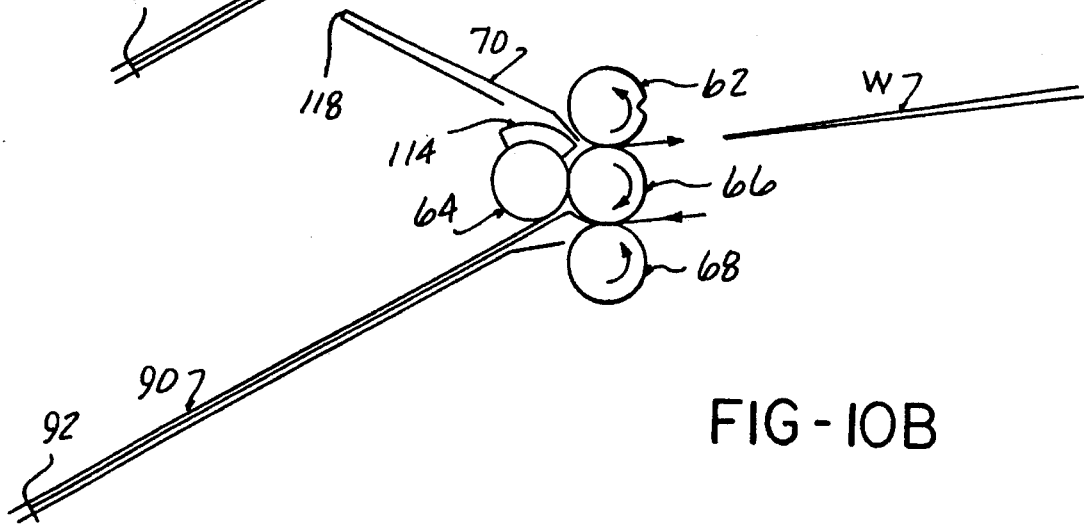

In FIG. 10B showing position 2, the adjustable stop blade 92 is shifted slightly towards the rollers. In this situation, a legal size sheet, 8½ by 14 inches, introduced between the main drive roller 66 and the lower roller 68, is again driven against the stop 92 in the adjustable stop chute 90, causing a buckling and capture between the first nip roller set comprised of the main drive roller 66 and the inside roller 64. The deflector bar 114 is in its blocking position as the cam roller has reached a relatively shallow depression 138, and hence the deflector shifted lever 126 is rotated counterclockwise, shifting the deflector bar 114 to the advanced blocking position. Thus, the once folded sheet is driven out of the machine between the rollers 62 and 66 forming a half fold of the legal size paper sheet.

Figure 10C:
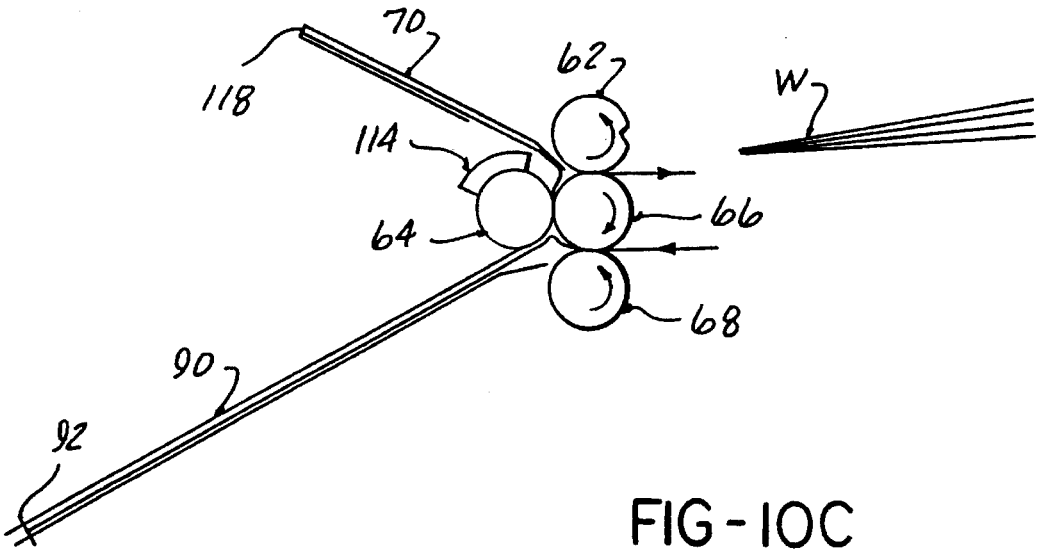

In FIG. 10C, the stop blade 92 is shifted slightly up towards the rollers. At the same time, the deflector bar 114 has been shifted to its retracted position since the cam roller 138 has reached the deep depression 136B, allowing clockwise rotation of the shifter lever 126 and thus shifting of the deflector bar 114 to a retracted position.

A sheet of legal size paper 8½ by 14 inches introduced between the rollers 66 and 68 is driven down the length of the adjustable stop stop chute 90, encountering the adjustable blade 92, and buckled so as to be captured between the first nip roller set, drawn therebetween and thence into the fixed stop chute 70 and against the fixed distance stop 118. This induces formation of second buckle of the once folded sheet when captured and drawn through the second nip roller set and thence out of the machine.

This set of adjustments will produce the double parallel folding of a legal size folded sheet as shown in FIG. 10C.

Figure 10D:
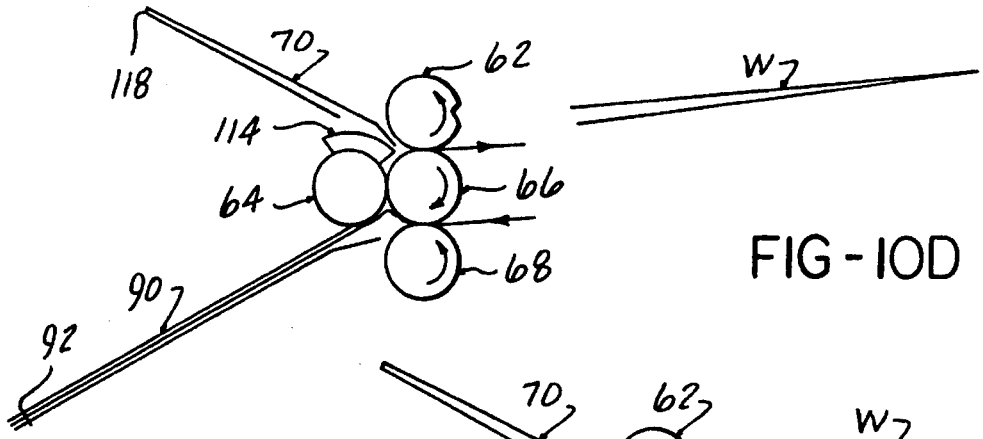

FIG. 10D shows position 4, with the deflector bar 114 in the blocking position and the stop blade 92 advanced to an intermediate position in the adjustable stop chute 90.

Accordingly, a sheet of 8½ by 11 inch paper introduced between rollers 66 and 68 will be driven against the stop blade 92 forming a buckle which is captured between the first nip roller set with the adjustment distance set such that a 5½ inch fold will be created at one end of the sheet. The folded sheet is then driven between the rollers 62 and 68 without passing into the fixed stop chute 70 and thus create the half fold pattern in the sheet of 8½ by 11 paper as shown in FIG. 10D.

Figure 10E:
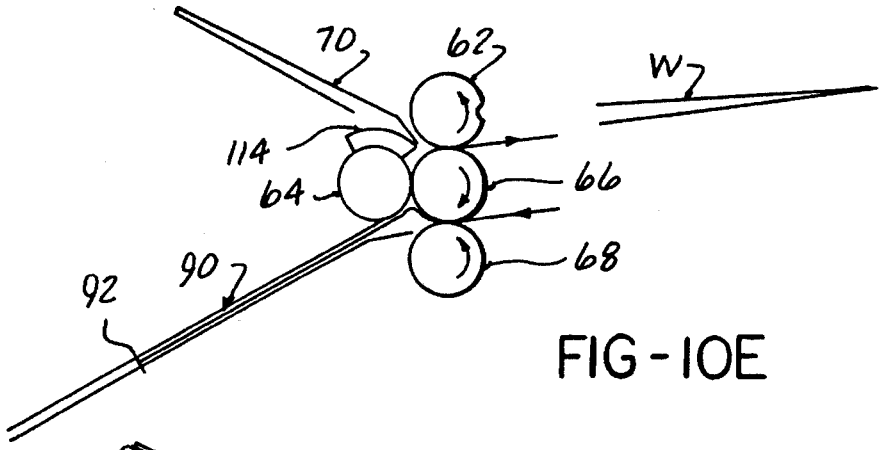

In FIG. 10E, position 5, the adjustable stop blade 92 is adjusted to a much closer position while the deflector bar 114 is in its blocking position such that a sheet of 5½ by 8 inch paper introduced between rollers 66, 68 will buckle at a position corresponding to approximately half the length of the 8 inch sheet of paper thence passing out between rollers 62 and 66 to form a half fold pattern of the 5½ by 4 inch paper.

Figure 10F:
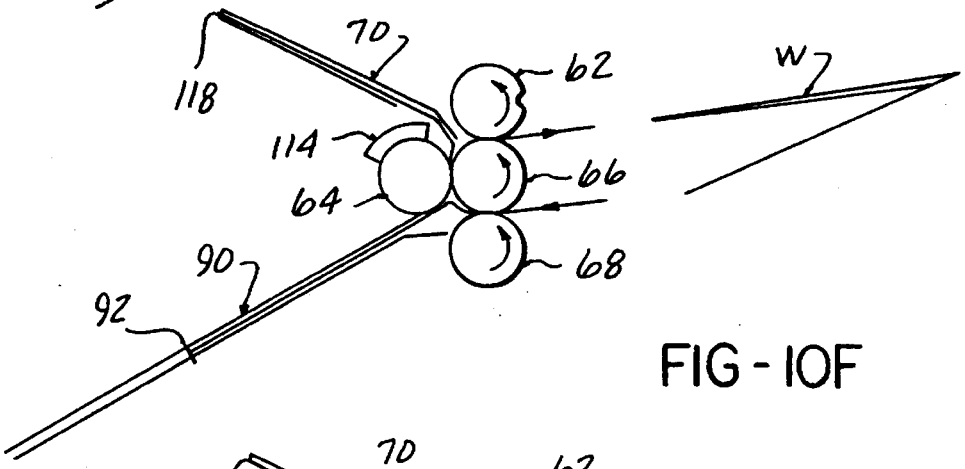

FIG. 10F shows position 6 in which the deflector bar 114 is retracted. The movable stop blade 92 is in a slightly closer position in the chute 90 such that a sheet 8½ by 11 inch paper introduced between rollers 66 and 68 will buckle against the stop 92 producing a short length fold. The once folded paper directed into the fixed stop chute 70 and against the fixed stop 118 is again buckled and captured by and drawn through the second nip roller set 66, 62 and passed out. This will produce a so-called C-fold in the sheet as shown with an approximate fold length of 3¾ inches as indicated.

Figure 10G:
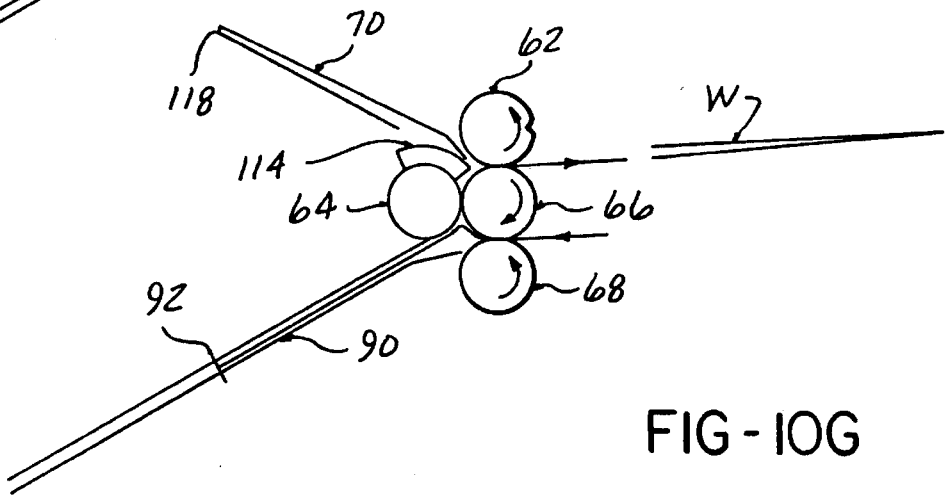

Finally, in position 7 shown in FIG. 10G, the adjustable stop blade 92 is at its nearmost position in the adjustable stop chute 90. The deflector bar 114 is in its advanced blocking position such that a sheet of 8½ by 7 inch paper introduced between the rollers 66, 68 will buckle to be folded at the approximate 3½ inch distance, and then pass out between rollers 62, 66, producing a half fold pattern for an 8½ by 7 sheet paper with the sheet folded length being approximately 3½ inches.

We claim:

1. A buckle chute sheet folding machine comprising:

a housing;

a drive roller set mounted in said housing;

drive means for rotating at least one roller of said drive roller set to enable advance of a foldable sheet which is introduced between said drive roller set at an entrance slot defined in said housing;

a first nip roller set adjacent said drive roller set on a side opposite a said wherein said sheet is introduced;

drive means for rotating said first nip roller set;

an adjustable stop of a first buckle chute disposed adjacent said drive roller set and located to receive a leading edge of said sheet after exiting said drive roller set;

a stop blade disposed extending across said first buckle chute to be engaged by said leading edge of said sheet;

adjustment means for selectively shifting the location of said stop blade in said first buckle chute in a direction along which said sheet is advanced;

said first nip roller set located to capture and draw in said sheet upon buckling of said sheet occurring after said leading edge thereof engages said stop blade and said drive rollers continue advance of remaining portions of said sheet, said sheet thereby folded with a first fold as said sheet is drawn through said first nip roller set;

a second buckle chute located to receive said folded sheet exiting said first nip roller set;

a second nip roller set located adjacent said first nip roller set on a side whereat said folded sheet exits said first nip roller set;

drive means for rotating said second nip roller set;

a deflector bar located between said first nip roller set and said second buckle chute and second nip roller set;

means mounting said deflector bar shiftable between an advanced position blocking a sheet from passing into said second buckle chute and a retracted position whereat said folded sheet is allowed to pass into said second buckle chute.

shifting means for selectively shifting said deflector bar between said advanced and retracted positions;

a stop in said second buckle chute engaging the folded edge of said folded sheet to cause buckling of said folded sheet;

said second nip roller set located to capture and draw in said buckled folded sheet, forming a second fold in said folded sheet and advancing said twice folded sheet out of said second nip roller set;

a single selector member mounted to said housing to be selectively movable to a series of adjusted positions, and means drivingly connecting said selector member to both said adjustment means for said stop blade in said first buckle chute and said shifting means for said deflector bar allowing simultaneous activation thereof by said selector member, whereby both the distance of the first fold from said leading edge of said sheet and the formation of a second fold may be selected by manipulation of said single selector member.

2. The buckle chute folder according to claim 1 wherein said selector member comprises a rotary knob, and wherein said adjustment means for said stop blade comprises a pair of drive belts, each attached to a respective end of said stop blade each having belt segments extending along said first buckle chute, said rotary knob being drivingly connected to each of said drive belt to cause synchronized movement of said belt segments along said buckle chute as said knob is rotated.

3. The buckle chute folder according to claim 2 wherein said shift means for said deflector bar comprises a lever and a rotary cam, said lever drivingly engaged by said rotary cam, said rotary cam drivingly connected to said knob to be rotated thereby.

4. The buckle chute folder according to claim 3 wherein said deflector bar is mounted for pivoting movement about the axis of one of said rollers, said lever is pivoted by said cam disc at predetermined rotated positions of said cam disc, said lever drivingly connected to said deflector bar to be swung between said advanced and retracted positions.

5. The buckle chute folder according to claim 4 wherein said lever carries a cam follower portion spring urged into engagement with said cam disc, said cam disc having a series of indentations providing detents for each of several rotated positions of said knob, at least one of said indentations of a depth sufficient to cause said deflector bar to be shifted, other indentations of a shallower depth not sufficient to cause shifting of said deflector bar, said shallow depth indentations providing detents for adjusted positions of said stop blade without causing shifting of said deflector bar.

6. The buckle chute folder according to claim 2 wherein said drive belts are each toothed, and wherein said adjustment means includes a pair of toothed pulley wheels both rotated by said knob and engaged by a respective drive belt.

7. The buckle chute folder according to claim 2 wherein said stop blade is sandwiched between sheet pieces defining said first buckle chute, said stop blade protruding at either end from said first buckle chute.

8. The buckle chute folder according to claim 1 wherein said drive roller set comprises a main drive roller and a second drive roller disposed adjacent said main roller, said first nip roller set includes said main drive roller and a first nip roller adjacent thereto and said second nip roller set includes said main roller and a second nip roller adjacent thereto.

9. The buckle chute folder according to claim 8 wherein said second nip roller is formed with at least one lengthwise slot extending said slot engaging a trailing edge of exiting an folded sheet after being driven out of said second nip roller set, to project said folded sheet clear of said second nip roller set to insure that a succeeding folded sheet is driven below the previously exiting folded sheet.

10. The buckle chute folder according to claim 8 wherein each of said second nip roller and said main drive roller are formed with spaced apart circumferential slots, and including a set of fingers each inserted into a respective circumferential groove in each of said second nip roller and said main drive roller to insure that a folded sheet passes out of said second nip roller set and does not adhere to either of said second nip roller or said main drive roller.

11. In a buckle chute sheet folding machine of the type having two folding chutes and a selectively shiftable blocking element for selectively setting one or two folding steps executed on a sheet by either allowing or preventing entrance of said sheet into one of said two folding chutes, and adjustment means for setting a plurality of fold patterns by varying the location of a fold executed on a sheet folded therein by adjustment of lengthwise adjustable stops associated with each of said two folding chutes, the improvement comprising a single selector member and drive means acting between said single selector member and said selectively shiftable element and said adjustment means to enable simultaneous selective setting of said one or two folding steps and said varying of said fold location by manipulation of said single selector member by movement of said member to successive positions whereat said blocking element shifted to be in either a blocking or nonblocking position and said lengthwise adjustable stops are set at predetermined adjusted lengthwise positions.

* * * * *